US007358936B2

(12) United States Patent
Kobayashi et al.

(10) Patent No.: US 7,358,936 B2
(45) Date of Patent: Apr. 15, 2008

(54) IMAGE DISPLAY APPARATUS

(75) Inventors: Yoshinao Kobayashi, Shiga (JP); Shinya Ono, Shiga (JP)

(73) Assignees: Kyocera Corporation, Kyoto (JP); Chi Mei Optoelectronics Corp. (TW)

( * ) Notice: Subject to any disclaimer, the term of this patent is extended or adjusted under 35 U.S.C. 154(b) by 667 days.

(21) Appl. No.: 10/860,036

(22) Filed: Jun. 4, 2004

(65) Prior Publication Data

US 2004/0246212 A1 Dec. 9, 2004

(30) Foreign Application Priority Data

Jun. 5, 2003 (JP) ..... 2003-161328

(51) Int. Cl.
*G09G 3/30* (2006.01)

(52) U.S. Cl. ..... 345/76; 345/82; 315/169.1

(58) Field of Classification Search ..... 345/76–83; 315/169.1–169.4

See application file for complete search history.

(56) References Cited

U.S. PATENT DOCUMENTS 6,229,506 B1 5/2001 Dawson et al.
6,373,454 B1 * 4/2002 Knapp et al. ..... 345/76
6,580,408 B1 * 6/2003 Bae et al. ..... 345/76
6,943,501 B2 * 9/2005 Kobayashi et al. ..... 315/169.3
6,950,082 B2 * 9/2005 Sung et al. ..... 345/82
2002/0196212 A1 * 12/2002 Nishitoba et al. ..... 345/76
2003/0052843 A1 * 3/2003 Yamazaki et al. ..... 345/82
2003/0146888 A1 * 8/2003 Yamazaki et al. ..... 345/82
2005/0007318 A1 * 1/2005 Kasai et al. ..... 345/76

* cited by examiner

*Primary Examiner*—Richard Hjerpe
*Assistant Examiner*—Kimnhung Nguyen
(74) *Attorney, Agent, or Firm*—Birch, Stewart Kolasch & Birch, LLP

(57) ABSTRACT

An image display apparatus includes a current-controlled light emitting; a transistor which controls a first current flowing through the current-controlled light emitting diode, based on a first voltage applied between the gate and the source of the transistor at a light emitting phase; a capacitor arranged between the gate and the source. The image display apparatus also includes a current determining unit which controls a second current flowing between the source and the drain, based on a third voltage applied thereto at the writing phase. The second voltage is written in the capacitor at a writing phase and depends on the second current.

9 Claims, 10 Drawing Sheets

IMAGE DISPLAY APPARATUS

This Non-provisional application claims priority under 35 U.S.C. § 119(a) on Patent Application No(s). 2003-161328 filed in Japan on Jun. 5, 2003, the entire contents of which are hereby incorporated by reference.

BACKGROUND OF THE INVENTION

1) Field of the Invention

The present invention relates to an image display apparatus including a current-controlled light emitting diode and a driver element that restricts a current value flowing into the current-controlled light emitting diode, and more specifically, relates to an image display apparatus that can write, a voltage including a threshold voltage fluctuation in the driver element, without using a special-purpose current source.

2) Description of the Related Art

An organic light emitting diode (hereinafter, "organic LED") display apparatus using an organic electroluminescent (EL) device that emits light itself, is most suitable for making the apparatus thin, since it does not require a backlight, which is required in a liquid crystal display apparatus, and does not have any limitation in the angle of visibility. Therefore, practical use thereof is expected as a next-generation display apparatus, which takes the place of the liquid crystal display apparatus.

As the image display apparatus using the organic LEDs, a simple (passive) matrix type and an active matrix type are known. The former has a simple configuration, but has a problem in that realization of a large-scale and highly delicate display is difficult. Therefore, development of the active matrix type display apparatus has been recently performed, which controls the current flowing into light emitting diodes in pixels, by an active element provided in the pixel, for example, a driver element including a thin film transistor.

Such a driver element is connected in series to the organic LED, and at the time of image display, a current equal to the current flowing into the organic LED flows to the driver element continuously. Therefore, when the image display apparatus is used over a long period of time, the electric characteristics of the driver element considerably deteriorates, causing a problem of, for example, fluctuations in the threshold voltage. When the electric characteristics of the driver element considerably deteriorates, a current having a value different from an intended value flows in the organic LED, and hence the luminance of the light emitted from the organic LED fluctuates, thereby deteriorating the quality of the displayed image.

Therefore, an image display apparatus having a compensation circuit for compensating the fluctuations in the electric characteristics of the driver element has been proposed. FIG. 10 is a circuit diagram depicting one example of the configuration of the image display apparatus having the compensation circuit. As shown in FIG. 10, the conventional image display apparatus includes a select line 210, and a data line 220 connected to a current source 230, and further includes p-type transistors 240, 250, and 260, which are connected to each other, and to the select line 210 and the data line 220, an n-type transistor 270, a capacitor 280, and an organic LED 290. The p-type transistor 260 serves as a driver element, and the capacitor 280 is connected between the gate and the source of the driver element. Therefore, the voltage applied to the capacitor 280 becomes the gate to source voltage of the p-type transistor 260, being the driver element, and the current value flowing in the p-type transistor 260 is determined based on the gate to source voltage.

The process for supplying potential to the capacitor 280 will be explained. At first, when the potential of the select line 210 becomes low, the p-type transistors 240 and 250 are turned on, so that the gate and the drain of the p-type transistor 260 become conductive to each other, and the data line 220 and the source electrode of the p-type transistor 260 become conductive to each other. It is assumed that the current source 230 connected to the data line 220 supplies electric current having a value corresponding to the display luminance, and the current is supplied to the p-type transistor 260 via the data line and the p-type transistor 250.

The gate electrode and the drain electrode of the p-type transistor 260 have the same potential, since the p-type transistor 240 is in the ON state, and hence the gate to source voltage corresponding to the current value supplied from the current source 230 is generated in the p-type transistor 260. Since the capacitor 280 is arranged between the gate electrode and the source electrode of the p-type transistor 260, a voltage corresponding to the gate to source voltage provided at this time is accumulated in the capacitor 280, thereby finishing the voltage write with respect to the capacitor 280. The voltage written in the capacitor 280 becomes the gate to source voltage of the p-type transistor 260, being the driver element, and at the time of light emission, current corresponding to such a voltage flows into the organic LED 290, thereby performing light emission.

Thus, the gate to source voltage of the p-type transistor 260 is determined based on the current actually flowing between the source and the drain. Therefore, even when fluctuations in the threshold voltage occur, the gate to source voltage including such fluctuations is determined. As a result, current having a desired value can be made to flow into the organic LED 290, regardless of deterioration in the p-type transistor 260 (See U.S. Pat. No. 6,229,506 for example).

In the circuit shown in FIG. 10, however, there is a problem in that long time is required for writing voltage in the capacitor 280. That is, in the configuration shown in FIG. 10, at a voltage writing phase, the current from the current source 230 is supplied to the p-type transistor 260 through the data line 220 and other wiring structures. Therefore, predetermined time is required until the current flowing into the p-type transistor 260 reaches a predetermined value, resulting from the parasitic capacitance included in the data line 220 and the like, and as a result, the time required for voltage write increases.

SUMMARY OF THE INVENTION

It is an object of the present invention to at least solve the problems in the conventional technology.

An image display apparatus to one aspect of the present invention includes a current-controlled light emitting; a transistor which controls a first current flowing through the current-controlled light emitting diode, based on a first voltage applied between the gate and the source of the transistor at a light emitting phase; a capacitor arranged between the gate and the source. The image display apparatus also includes a current determining unit which controls a second current flowing between the source and the drain, based on a third voltage applied thereto at the writing phase. The second voltage is written in the capacitor at a writing phase and depends on the second current.

An image display apparatus to another aspect of the present invention includes a current-controlled light emitting; and a transistor including a gate, a source, and a drain, and controlling a first current flowing through the current-controlled light emitting diode at a light emitting phase. In operation of the image display apparatus, there is a period when a voltage lower than a potential of one of the source and the drain is applied to the gate for each frame which displays one image.

The other objects, features, and advantages of the present invention are specifically set forth in or will become apparent from the following detailed description of the invention when read in conjunction with the accompanying drawings.

DETAILED DESCRIPTION

Exemplary embodiments of an image display device and an image display apparatus according to the present invention will be explained below, with reference to the drawings. The drawings are only schematic, and are different from the actual ones. It is a matter of course that parts having different relations and ratios in mutual dimensions are included in the accompanying drawings.

The image display apparatus according to the embodiment of the present invention will be explained first. The image display apparatus has a configuration having a current determining unit that allows a desired current to flow to a driver element based on a voltage supplied from outside, at the time of writing a voltage, taking into consideration fluctuations in the threshold voltage of the driver element, in individual display pixels.

Figure 1:
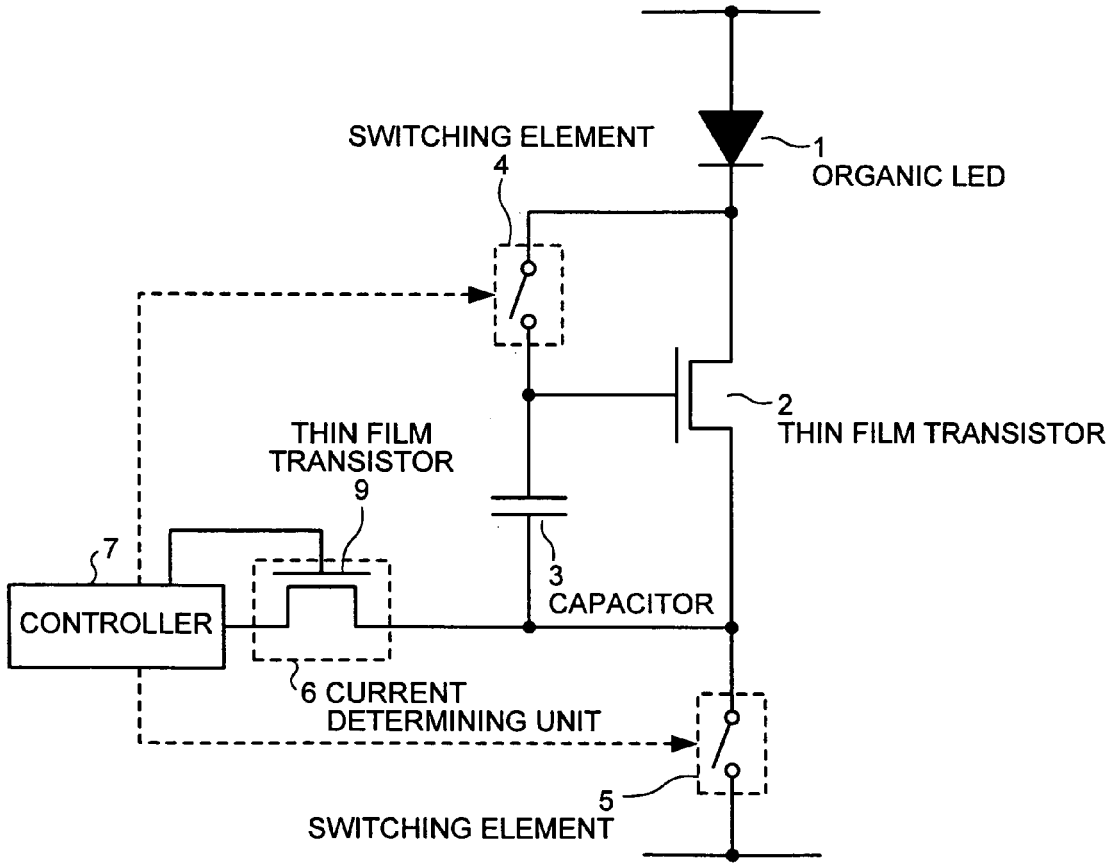
FIG. 1 depicts the configuration of an image display apparatus according to one embodiment.

FIG. 1 is an equivalent circuit diagram of a circuit configuration of a portion corresponding to the structure of a single display pixel, of the configuration of the image display apparatus according to the embodiment. The actual image display apparatus has a configuration in which the circuit configurations shown in FIG. 1 are arranged in a matrix.

As shown in FIG. 1, the image display apparatus according to the embodiment includes an organic LED 1, being the current-controlled light emitting diode, a thin film transistor 2 serving as the driver element, and a capacitor 3 arranged between the gate electrode and the source electrode of the thin film transistor 2, in which a predetermined voltage is written at a voltage writing phase. At a light emitting phase, a voltage equal to the voltage accumulated in the capacitor 3 is applied to between the gate and the source of the thin film transistor 2, and based on such a voltage, a predetermined current flows in the organic LED 1 to perform image display.

The image display apparatus according to the embodiment further includes a switching element 4 that controls electric conduction between the gate and the drain of the thin film transistor 2, a switching element 5 that changes the current path flowing in the thin film transistor 2 at the time of voltage write and at the time of light emission, a current determining unit 6 that determines the current value flowing in the thin film transistor 2 at the time of voltage write based on the applied voltage, and a controller 7 that controls the switching elements 4 and 5, and the current determining unit 6.

The organic LED 1 serves as the current-controlled light emitting diode that emits light with the luminance corresponding to the injected current value. Specifically, the organic LED 1 has a configuration in which an anode layer, a light emitting layer, and a cathode layer are sequentially laminated. The light emitting layer is for radiative recombination of the electrons injected from the cathode layer side and holes injected from the anode layer side. Specifically, the light emitting layer is formed of an organic material, such as phthalocyanine, trisaluminum complex, benzoquinolinolate, and beryllium complex, and has a structure of being bonded with impurities as required. The organic LED 1 may have such a configuration in which a hole transporting layer is provided on the anode side with respect to the light emitting layer, and an electron transporting layer is provided on the cathode side with respect to the light emitting layer.

The thin film transistor 2 serves as the driver element that controls the current value flowing into the organic LED 1. Specifically, the thin film transistor 2 is serially connected to the organic LED 1 via one of the source and drain electrodes, and has a function of flowing a current having a value corresponding to the gate to source voltage to the organic LED 1. The thin film transistor 2 preferably has a configuration in which a channel forming area serving as a current-carrying layer is formed of amorphous silicon. Use of the amorphous silicon provides an advantage in that the channel forming area can suppress a fluctuation in the voltage-current characteristic for each display pixel, resulting from a difference in a physical structure of the channel forming area.

The switching elements 4 and 5 have a function of repeating ON and OFF based on the control of the controller 7. Specifically, the switching element 4 is controlled by the controller 7 so that it becomes the ON state at a reset phase and at the voltage writing phase described later, and becomes the OFF state at the light emitting phase.

The current determining unit 6 allows a current having a value determined based on a predetermined voltage supplied by the controller 7 at the voltage writing phase to flow to the thin film transistor 2. So long as such a function is achieved, the current determining unit 6 may have an optional configuration. In the embodiment, however, an example in which the current determining unit 6 is formed of a thin film transistor 9 will be explained. That is, in the embodiment, the current determining unit 6 has a configuration such that a predetermined potential is applied from the controller 7 to between the gate and the source of the thin film transistor 9, so that a predetermined current is allowed to flow to between the drain and the source.

It is preferable that the thin film transistor 9 used as the current determining unit 6 be driven in a saturation region, due to the reason described later. The saturation region stands for a state that the drain voltage dependency of the current flowing between the source and the drain is dissolved by setting the drain voltage of the thin film transistor to a predetermined value or above. The thin film transistor 9 may have an optional configuration by using an optional material, but generally, has a configuration in which the channel forming area is formed of the amorphous silicone, as in the thin film transistor 2.

The controller 7 controls the operation of the switching elements 4 and 5, and the current determining unit 6. Specifically, the controller 7 controls ON and OFF of the switching elements 4 and 5, ON and OFF of the current determining unit 6, and a value of the current allowed to flow by the current determining unit 6. The controller 7 has a configuration such that it supplies a voltage to at least the current determining unit 6 to perform the control. As an actual configuration of the controller 7, for example, it is preferable that the controller 7 includes data lines, scan lines, and the like electrically connected to the switching elements 4 and 5 and the current determining unit 6, and one or more driving circuits connected to the data lines and the like, but in FIG. 1, these are simplified, and expressed by a single block. In FIG. 1, the controller 7 has a configuration of being connected to a plurality of electrodes of the thin film transistor 9 forming the current determining unit 6, but the controller 7 is not limited to such a configuration.

Figure 2A:
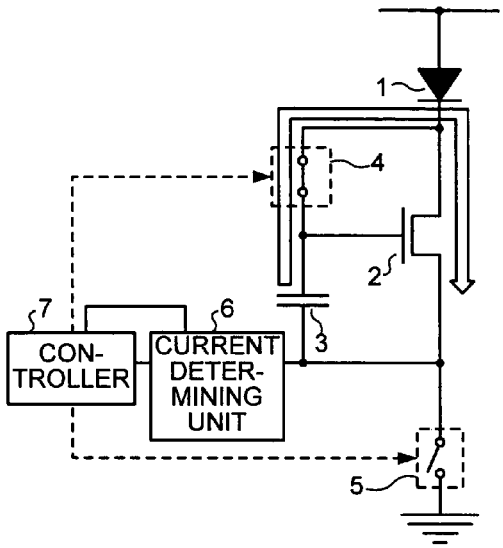
FIGS. 2A to 2C are schematic diagrams for explaining the operation of the image display apparatus according to the embodiment.
Figure 2B:
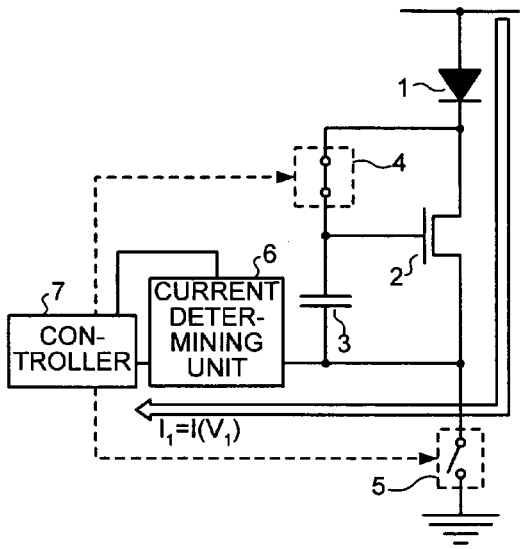
Figure 2C:
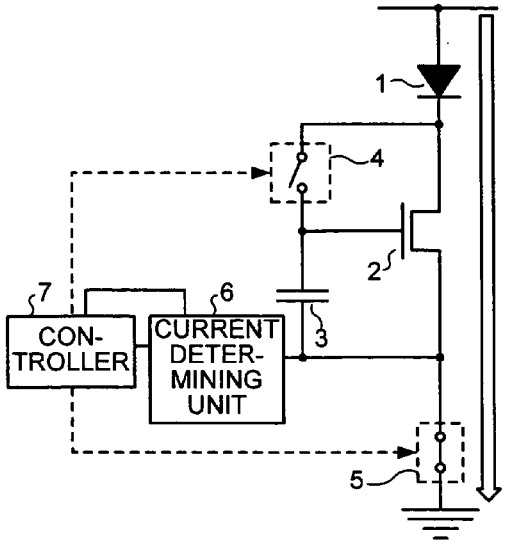

The operation of the image display apparatus according to the embodiment will be explained below. The image display apparatus has a configuration such that the reset phase, the voltage writing phase, and the light emitting phase are performed during one frame that displays one image. FIGS. 2A to 2C are schematic diagrams of the state of the image display apparatus at the voltage writing phase. Specifically, FIG. 2A corresponds to the reset phase, FIG. 2B corresponds to the voltage writing phase, and FIG. 2C corresponds to the light emitting phase.

The reset phase will be explained first, referring to FIG. 2A. At the reset phase, the electric charges accumulated in the capacitor in the previous frame are discharged, so that the gate to source voltage of the thin film transistor 2 drops to a value equal to the threshold voltage.

As shown in FIG. 2A, at the reset phase, the controller 7 controls so that the switching element 4 becomes the ON state, and the switching element 5 and the current determining unit 6 become the OFF state. Since the switching element 4 becomes the ON state, the gate electrode and the drain electrode of the thin film transistor 2 become conductive to each other, and the electric charges are shifted so that the potential of these electrodes becomes equal. The thin film transistor 2 becomes the ON state due to the electric charges accumulated in the capacitor 3 in the previous frame. Therefore, the electric charges accumulated in the capacitor 3 in the previous frame are discharged from the capacitor 3, passing through the switching element 4 and between the source and the drain of the thin film transistor 2.

On the other hand, since the capacitor and the gate electrode of the thin film transistor 2 are directly connected to each other, the gate to source potential of the thin film transistor 2 also decreases gradually, with the discharge of the electric charge from the capacitor 3. Then finally, the gate to source voltage decreases to a value equal to the threshold voltage, and the thin film transistor 2 becomes the OFF state. Since the thin film transistor 2 becomes the OFF state, discharge of the electric charge from the capacitor 3 is suspended, and hence the gate to source voltage of the thin film transistor 2 is maintained at the value of the threshold voltage. Thus the reset phase finishes.

The voltage writing phase will be explained next. At the voltage writing phase, the voltage corresponding to the light emitting luminance of the organic LED 1 is written in the capacitor 3, by letting a predetermined current to flow by using the current determining unit 6.

As shown in FIG. 2B, at the voltage writing phase, the controller 7 controls such that the switching element 4 becomes the ON state, and the switching element 5 becomes the OFF state. On the other hand, the controller 7 supplies to the current determining unit 6 a voltage $V_1$ corresponding to the current $I_1$, based on the IV characteristics of the current determining unit 6, so that the current determining unit 6 allows a current $I_1$ corresponding to the light emitting luminance of the organic LED 1 to flow.

At the reset phase, since the gate to source voltage of the thin film transistor 2 is substantially equal to the threshold voltage, the thin film transistor 2 becomes the ON state at the voltage writing phase. Therefore, the current $I_1$ determined by the current determining unit 6 flows in the organic LED 1, the thin film transistor 2, and the current determining unit 6, respectively connected to each other in series. As a result, the current $I_1$ flows between the source and the drain of the thin film transistor 2, and hence a gate to source voltage $V_2$ corresponding to the value of the current $I_1$ is generated between the gate and the source of the thin film transistor 2. Then, as shown in FIG. 2B, since the capacitor 3 is arranged between the gate electrode and the source electrode of the thin film transistor 2, the voltage $V_2$ equal to the gate to source voltage of the thin film transistor 2 is written in the capacitor 3. Thus, the voltage writing phase finishes. In the above explanation and in FIG. 2B, the switching element 4 maintains the ON state, but it is preferable that the switching element 4 becomes the OFF state in the middle of the voltage writing phase. This is for preventing the voltage written in the capacitor 3 from being discharged to the outside via the switching element 4.

The light emitting phase will now be explained. At the light emitting phase, a predetermined current flows into the organic LED 1 based on the voltage written in the capacitor 3 at the voltage writing phase, so that the organic LED 1 emits light at a desired luminance.

As shown in FIG. 2C, the controller 7 controls so that the switching element 4 and the current determining unit 6 become the OFF state, while the switching element 5 becomes the ON state. On the other hand, since the voltage $V_2$ has been written in the capacitor 3 at the voltage writing phase, the gate to source voltage of the thin film transistor 2 has a value equal to the voltage $V_2$ written in the capacitor 3. The voltage $V_2$ is the gate to source voltage in the thin film transistor 2, when the current $I_1$ flows therein at the voltage writing phase. Therefore, the current $I_1$ flows between the source and the drain of the thin film transistor 2 at the light emitting phase as well, and also flows in the organic LED 1 serially connected thereto. Since the current $I_1$ has a value determined corresponding to the luminance to be realized, the organic LED 1 emits light at a desired luminance at the light emitting phase. Thus, the light emitting phase finishes, and at the time of performing image display of the next frame, control returns to the reset phase to perform the similar processing.

As explained above, in the image display apparatus according to the embodiment, the current determining unit 6 determines a current value corresponding to the light emitting luminance of the organic LED 1, based on the voltage supplied from the controller 7. Here, the reason why the image display apparatus according to the embodiment does not determine the current value flowing into the thin film transistor 2 directly by the current source as in the conventional apparatus, but the controller 7 supplies a predetermined voltage to the current determining unit 6, and the current determining unit 6 determines the current value based on the voltage will be explained.

In the configuration shown in FIG. 1, the controller 7 is schematically shown, but in the actual image display apparatus, the controller 7 performs control with respect to all display pixels, and is normally arranged outside of an image display panel in which the display pixels are accumulated. The controller 7 has such a configuration that it controls circuit elements forming display pixels via a wiring structure such as data lines, scan lines, and the like from an area away from the display pixels. Therefore, when the configuration is such that the controller 7 serves as the current source, and directly supplies current to the thin film transistor 2, the parasitic capacitance existing while the current reaches the thin film transistor 2 from the controller 7 becomes a problem. Specifically, due to the existence of the parasitic capacitance, a certain period of time is required until the value of the current flowing in the thin film transistor 2 becomes equal to the value supplied from the current source, and hence it becomes difficult to execute the voltage writing phase in short time.

On the other hand, even if the controller 7 is arranged away from the display pixels, at the time of supplying the voltage, the existence of parasitic capacitance is not a problem. Therefore, when the configuration is such that the controller 7 supplies the voltage to the current determining unit 6, the voltage can be supplied to the current determining unit 6 quickly, regardless of the distance between the controller 7 and the current determining unit 6, and hence the voltage writing phase can be executed in short time.

Though not particularly mentioned in the explanation of operation with reference to FIGS. 2A to 2C, the thin film transistor 9 constituting the current determining unit 6 operates in the saturation region. It will be explained below that fluctuation in the IV characteristics of the current determining unit 6 can be suppressed, by operating the thin film transistor 9 in the saturation region.

In the embodiment, the image display apparatus has a configuration such that the current value is not determined directly by the current source, but the current determining unit 6 determines the current flowing in the thin film transistor 2 based on the voltage supplied from the controller 7. Actually, the current value to be allowed to flow is determined beforehand corresponding to the luminance of the organic LED 1, and the controller 7 determines the voltage V to be supplied to the current determining unit 6, based on the IV characteristics of the current determining unit 6. Therefore, the controller 7 needs to understand the IV characteristics of the current determining unit 6, and the IV characteristics of the current determining unit 6 should be stable. In other words, even if the controller 7 supplies a voltage V, to the current determining unit 6 so that a current $I_1$ is allowed to flow, if the current determining unit 6 determines a current $I_2$ ($I_2 \neq I_1$) based on the voltage $V_1$, due to fluctuations in the IV characteristics, a wrong voltage is written in the capacitor 3 at the voltage writing phase. In this case, the luminance of the organic LED 1 at the light emitting phase becomes different from the desired luminance. Therefore, it is very important that the IV characteristics of the current determining unit 6 are stable.

In the embodiment, therefore, when the current determining unit 6 is formed of a thin film transistor, fluctuations in the threshold voltage, being the major value of the IV characteristics, are suppressed by designing the driven state. Specifically, when the thin film transistor 9 is driven, the potential of the drain electrode is maintained at a predetermined value or higher, so that the thin film transistor is operated in the saturation region.

Figure 3:
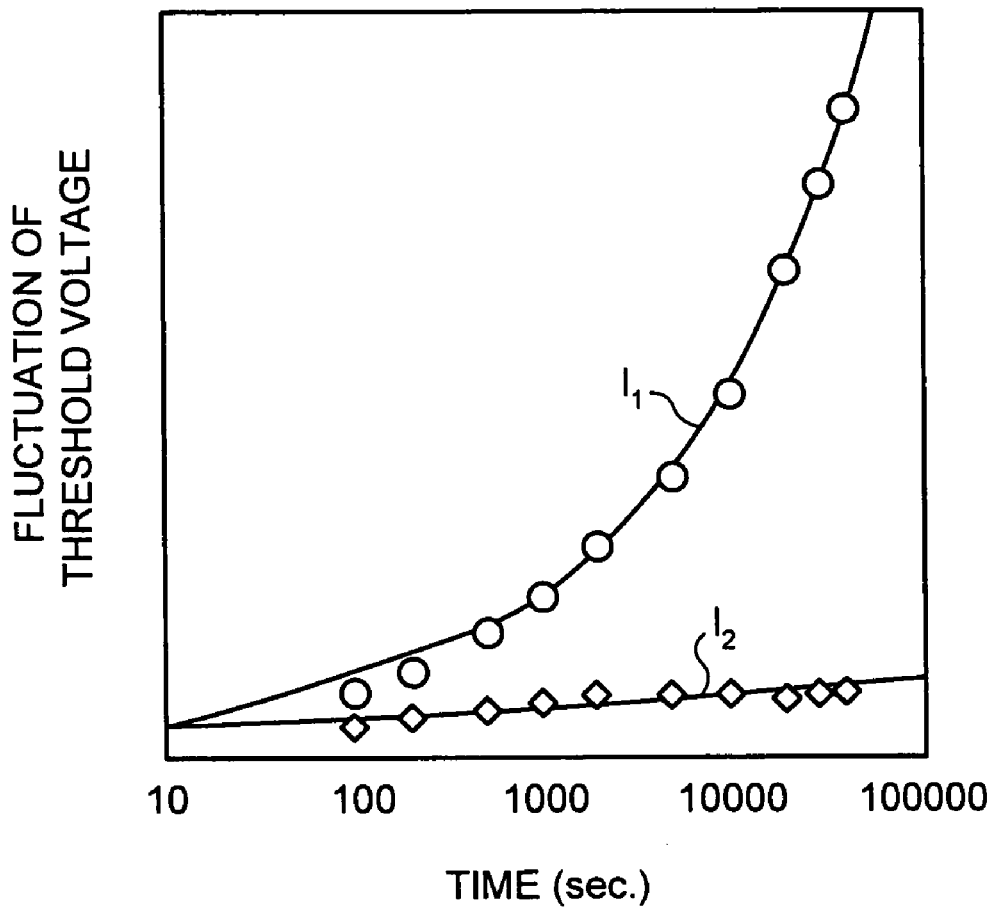
FIG. 3 is a graph for comparing a threshold voltage fluctuation margins when a thin film transistor is operated in a saturation region and when the thin film transistor is operated in a linear area.

FIG. 3 is a graph for comparing fluctuations of threshold with respect to the time fluctuation, when the thin film transistors having the same configuration are driven in the saturation region and in a linear area. In FIG. 3, a curve $I_1$ indicates a situation when the thin film transistor is operated in the linear area, and a curve $I_2$ indicates a situation when the thin film transistor is operated in the saturation region.

As shown in FIG. 3, the fluctuation in the threshold voltage clearly decreases when the thin film transistor is operated in the saturation region (curve $I_2$), as compared with when the thin film transistor is operated in the linear area (curve $I_1$). For example, when a comparison is made at a point in time when 100,000 seconds have passed, the fluctuation in the threshold voltage when the thin film transistor is operated in the saturation region is suppressed to 1/10 or below of the fluctuation in the threshold voltage when the thin film transistor is operated in the linear area. Therefore, by operating the thin film transistor 9 in the saturation region, the fluctuation in the threshold voltage can be suppressed.

In the image display apparatus according to the embodiment, therefore, by driving the thin film transistor 9 in the saturation region, the fluctuation in the threshold voltage of the thin film transistor can be suppressed, thereby enabling suppression of fluctuations in the IV characteristics of the current determining unit 6.

In the embodiment, the current is made to flow in the current determining unit 6 only during the voltage writing phase, and at the reset phase and the light emitting phase, the thin film transistor used as the current determining unit 6 maintains the OFF state, and hence the current does not flow therein. Since the voltage writing phase finishes by writing a predetermined potential in the capacitor 3, normally several microseconds to 20 microseconds are sufficient for one frame.

On the other hand, at the light emitting phase, image is displayed by allowing the organic LED 1 to emit light with a desired luminance. Therefore, for example, at a refresh rate of 60 hertz, that is, when 60 images are displayed in one second, about half of 16 milliseconds allowed for one frame are normally spent for the light emitting phase.

It is assumed herein that the time allowed for one frame is 16 milliseconds, the time while the current flows in the current determining unit 6 is 16 microseconds per one frame, and the time spent for the light emitting phase is half the frame, that is, 8 microseconds. Under such assumption, fluctuations in the threshold voltage when image display is performed over 20000 hours, which is requested as the product life cycle with respect to a general image display apparatus is considered. Under such an environment, when the time during which the current flows in the thin film transistor 9 and the time during which the current flows in the thin film transistor 2 are derived, the time $t_1$ during which the current flows in the thin film transistor 9 becomes:

$$t_1=20000[h]\times 60[m/h]\times 60[s/m]/(16\times 10^{-3}[ms]/16[ms])=7.2\times 10^4[s].$$

On the other hand, the time $t_2$ during which the current flows in the thin film transistor 2 becomes:

$$t_2=20000[h]\times 60[m/h]\times 60[s/m]/(8[ms]/16[ms])=3.6\times 10^7[s].$$

Therefore, the time $t_2$ becomes a value of about 500 times as much as the time $t_1$, and when it is assumed that the same current flows in the thin film transistors 2 and 9, the ratio of the gross weight of the electric charge passing through the current determining unit 6 to the electric charge passing through the thin film transistor 2 becomes about 1:500. Since the thin film transistor 9 operates in the saturation region, the fluctuations in the threshold voltage are suppressed to 1/10 or below of the fluctuation margin of the thin film transistor 2, and hence the IV characteristics of the current determining unit 6 can be stabilized by using the thin film transistor 9.

Figure 4A:
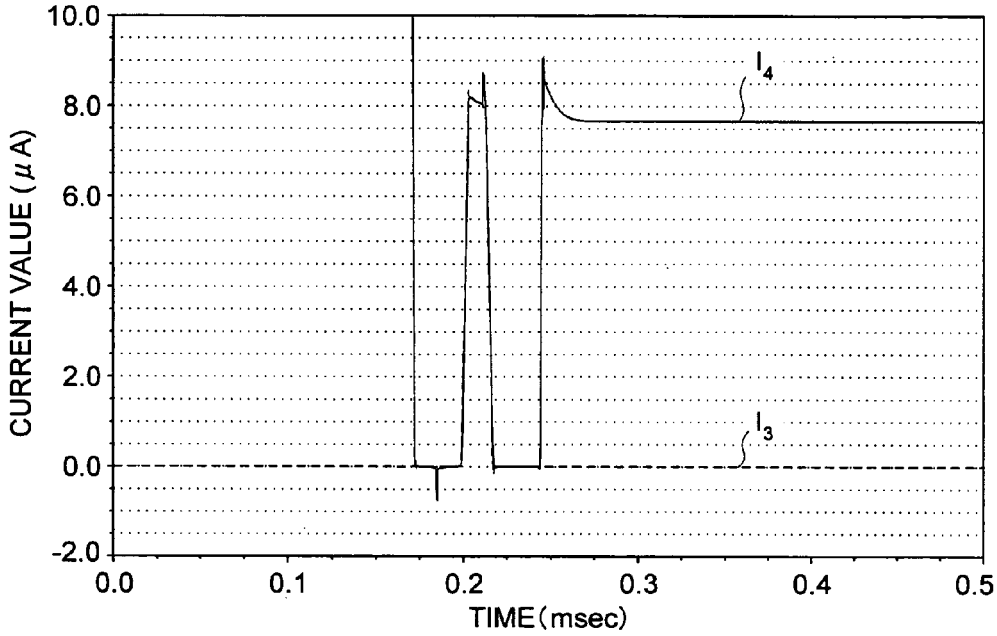
FIG. 4A is a graph of the time fluctuation in the current flowing in a driver element and an organic LED when operated in a state of having no fluctuations in threshold voltage.
Figure 4B:
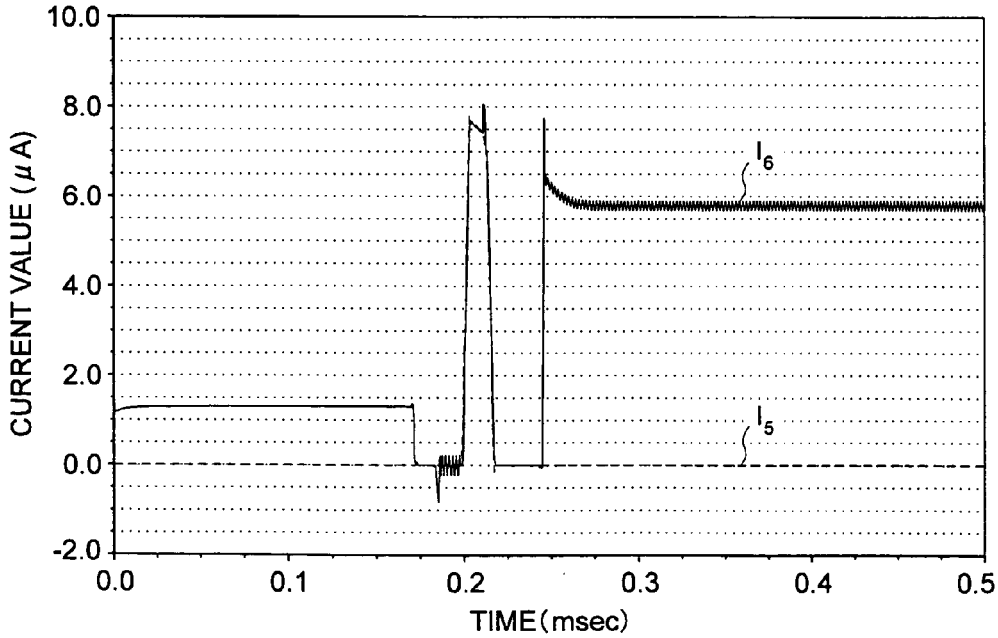
FIG. 4B is a graph of the time fluctuation in the current flowing in the driver element and the organic LED after having been operated for 20,000 hours.

The inventors of the present invention have actually designed a circuit for the image display apparatus according to the embodiment, and studied the voltage writing accuracy by performing numerical calculation for the designed circuit. FIGS. 4A and 4B are graphs of the calculation results relating to the current flowing in the thin film transistor 9 and in the organic LED 1 at the voltage writing phase and the light emitting phase. Specifically, FIG. 4A depicts the situation immediately after starting to use the image display apparatus, that is, fluctuations in the threshold voltage do not occur in the thin film transistors 2 and 9, and FIG. 4B depicts the situation when 20,000 hours, which is requested as the product life cycle, have passed, and the threshold voltage of the thin film transistor 9 increased by about 100%. In FIGS. 4A and 4B, curves $I_3$ and $I_5$ indicate a time fluctuation in the current flowing in the thin film transistor 9, and curves $I_4$ and $I_6$ indicate a time fluctuation in the current flowing in the organic LED 1. In the both graphs of FIGS. 4A and 4B, the voltage writing phase is being performed at the time close to 0.2 millisecond, and the light emitting phase is being performed at the time close to 0.25 millisecond.

As shown in FIG. 2B, at the voltage writing phase, equal current flows in the organic LED 1 and the thin film transistor 9. Therefore, the curves $I_3$ and $I_5$, and the curves $I_4$ and $I_6$ agree with each other very accurately at the time close to 0.2 millisecond. When FIG. 4A and FIG. 4B are compared, the fluctuation margin of the absolute value of the current flowing at the time of voltage writing phase is suppressed to about 0.5 microampere, to about 6% in percentage, though the image display apparatus has been operated over 20,000 hours.

When FIG. 4A and FIG. 4B are compared relating to the light emitting phase, though the image display apparatus has been operated over 20,000 hours, the current value flowing in the organic LED 1 at the light emitting phase changes only from about 7.5 to about 6.0 microamperes. That is, the image display apparatus according to the embodiment can suppress the current flowing in the organic LED 1, after having been used over 20,000 hours, to a reduced range of about 20 to 25% in percentage.

In a general image display apparatus, the time until the display luminance drops to about 50% of a value immediately after production has a significant meaning as the product life cycle. Regarding the image display apparatus according to the embodiment, the display luminance is determined by the current value supplied to the organic LED 1 and the light emitting efficiency of the organic LED 1 itself, and hence the product life cycle is determined by the fluctuation margin of these values. Since the image display apparatus according to the embodiment can suppress the fluctuation margin of the current value supplied to the organic LED 1 to about 20%, a margin of about 25% can be provided with respect to the fluctuations in the light emitting efficiency of the organic LED 1 itself. Therefore, in the image display apparatus according to the embodiment, materials constituting the organic LED 1 can be selected also from materials, which cause some fluctuations in the light emitting efficiency, thereby providing an advantage in that the choices of the material increase.

In the embodiment, it is preferable that not only the reset phase, the voltage writing phase, and the light emitting phase, but also a reverse voltage applying step be added. At the reverse voltage applying step, a voltage of a polarity different from the ON voltage (hereinafter, "reverse voltage") to the gate electrode is applied, while the thin film transistor 9 is in the OFF state. Specifically, since the ON voltage is positive in the case of an n-channel transistor, a negative potential is applied to the gate electrode at the reverse voltage applying step. By adding the reverse voltage applying step, fluctuations in the threshold voltage of the thin film transistor 9 can be further suppressed, thereby further stabilizing the IV characteristics of the current determining unit 6.

The fluctuations in the threshold voltage of the thin film transistor are caused by various factors, but one factor is that carriers (electrons in the case of the n-channel transistor) of a polarity different from the ON voltage are drawn close to the gate electrode, for example, to the inside of a gate insulating layer, by continuously applying the ON voltage to the gate electrode. The carriers drawn close to the gate electrode have a polarity different from the ON voltage. Therefore, it is presumed that the effective value of the voltage applied to the channel forming area of the thin film transistor decreases, thereby causing fluctuations in the threshold voltage value.

Therefore, it is presumed that by excluding the carriers of a polarity different from the ON voltage from near the gate electrode, the fluctuation margin in the threshold voltage is decreased. Specifically, by applying a polarity different from the ON voltage to the gate electrode for a certain period of time, the carriers drawn close to the gate electrode receive a repulsive force, and hence return to the original position. As a result, at least a part of the primary factors of fluctuations in the threshold voltage is removed, thereby decreasing the fluctuation margin of the threshold voltage.

Figure 5:
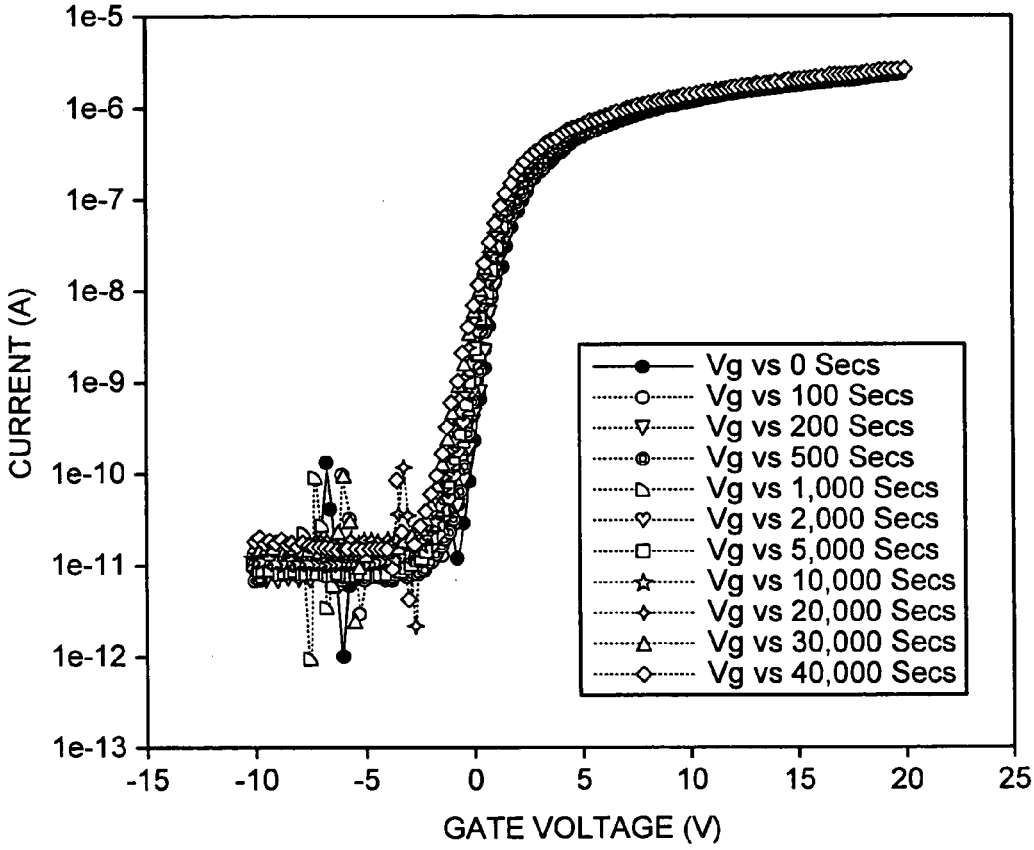
FIG. 5 is a graph depicting that a fluctuation margin of the threshold voltage of the thin film transistor decreases when a reverse voltage is applied to a gate electrode.

FIG. 5 is a graph depicting that the fluctuation margin of the threshold voltage can be reduced by applying a reverse voltage for a certain period of time to a thin film transistor, in which fluctuations in the threshold voltage have occurred due to the operation for long time and the threshold voltage has increased. It is assumed that the thin film transistor used for the measurement of the graph in FIG. 5 is the n-channel transistor, and a difference in the effect is studied by applying a voltage of −4 volts to the gate electrode as the reverse voltage and changing the time for applying the reverse voltage. Specifically, the IV characteristics of the thin film transistor are studied, when the reverse voltage is applied for 0 second, 100 seconds, 200 seconds, . . . , and 40,000 seconds. The potential of the drain electrode at the time of applying the reverse voltage is 16.5 volts.

As shown in FIG. 5, the IV curve indicated by the thin film transistor is shifted to the negative direction on the X axis, as the application time of the reverse voltage becomes long. This is because the threshold voltage has increased due to the longtime use of the thin film transistor used for the measurement. Therefore, the shift of the IV curve to the negative direction on the X axis means that the fluctuation margin of the threshold voltage caused by the longtime use is decreased, and from the measurement results shown in FIG. 5, it is clear that the reverse voltage applying step can reduce the fluctuation margin of the threshold voltage.

Thus, by newly adding the reverse voltage applying step, fluctuations in the IV characteristics of the thin film transistor 9 constituting the current determining unit 6 can be suppressed, and hence fluctuations in the current I determined based on the voltage V applied from the controller 7 can be further suppressed. Therefore, the image display apparatus according to the embodiment has an advantage in that the voltage writing phase can be executed more accurately by executing the reverse voltage applying step.

The reverse voltage applying step may be executed separately from the reset phase, the voltage writing phase and the light emitting phase, but in the embodiment, it is preferable to execute the reverse voltage applying step together with the reset phase or the light emitting phase. As shown in FIGS. 2A to 2C, it is only at the time of performing the voltage writing phase that the thin film transistor 9 becomes the ON state in the operation of the image display apparatus according to the embodiment, and at the time of performing the reset phase and the light emitting phase, the thin film transistor 9 is maintained in the OFF state. Therefore, even when the reverse voltage applying step is performed at the time of performing either the reset phase or the light emitting phase, it does not adversely affect the operation of the reset phase and the light emitting phase. Therefore, in the image display apparatus according to the embodiment, the reverse voltage applying step can be performed at the same time with the reset phase or the light emitting phase, and hence the image display apparatus has an advantage in that, for example, it is not necessary to reduce the time required for the light emitting phase.

EXAMPLE 1

Figure 6A:
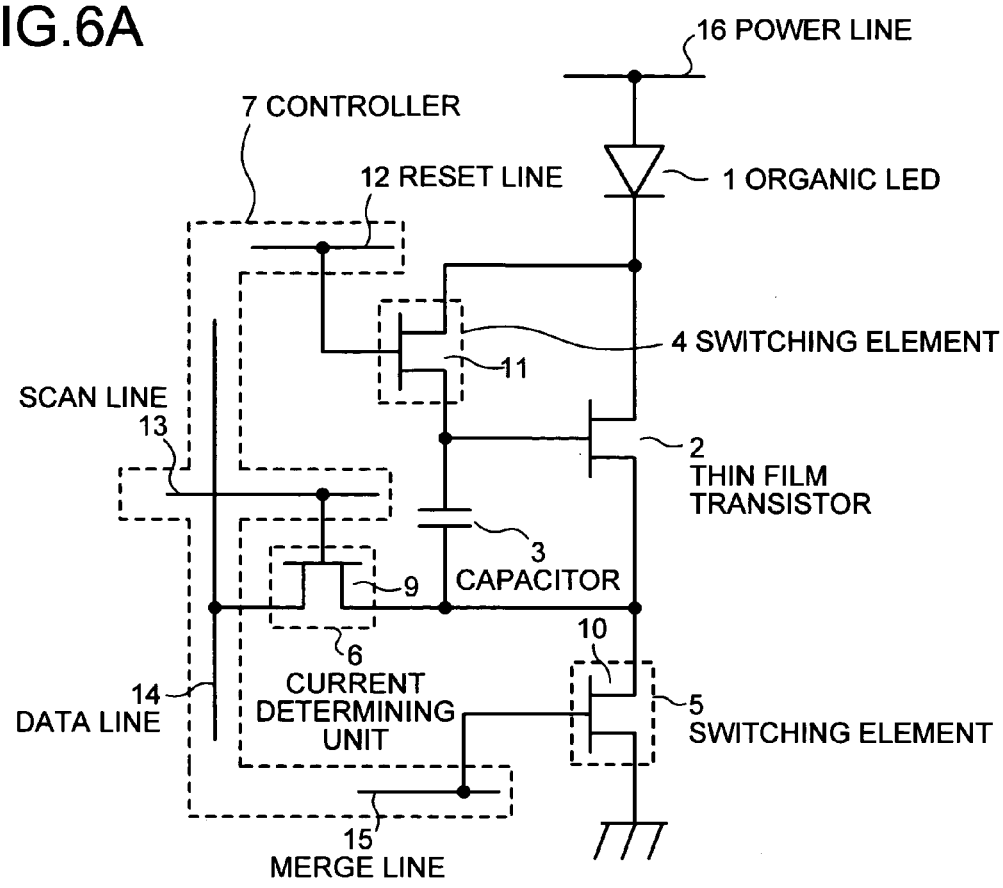
FIG. 6A depicts a circuit configuration in Example 1.
Figure 6B:
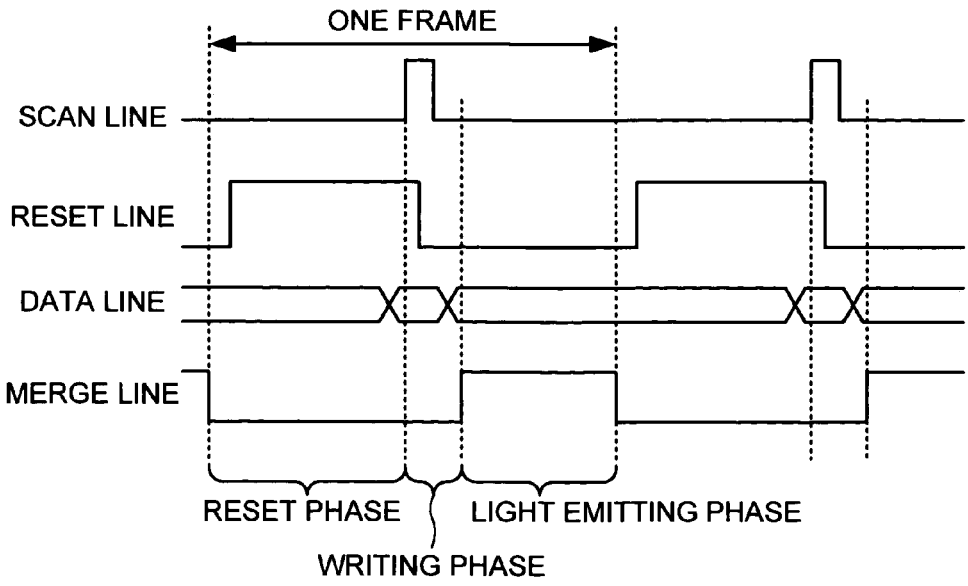
FIG. 6B is a timing chart of the image display apparatus according to Example 1.

Example 1 in which circuit elements are actually used to form the image display apparatus according to the embodiment will be explained below. FIG. 6A is an equivalent circuit diagram of the configuration of the image display apparatus according to Example 1, and FIG. 6B is a timing chart depicting the time fluctuation in the drive waveform in the image display apparatus according to Example 1. In FIG. 6A, the correspondence between the respective circuit elements and the components shown in FIG. 1 are clarified, in order to ensure the consistency with FIG. 1.

As shown in FIG. 6A, in the image display apparatus according to Example 1, the organic LED 1, the thin film transistor 2, and the capacitor 3 are arranged in the same positions as in FIG. 1, a thin film transistor 11 is arranged as the switching element 4, and a thin film transistor 10 is arranged as the switching element 5. The current determining unit 6 is formed of the thin film transistor 9 operating in the saturation region, which suppresses the fluctuations in the threshold voltage, thereby realizing the current determining unit 6 having stable IV characteristics.

The thin film transistor 11 as the switching element 4 is connected to a reset line 12 at the gate electrode, the thin film transistor 10 as the switching element 5 is connected to a merge line 15, the gate electrode of the thin film transistor 9 as the current determining unit 6 is connected to the scan line 13, and the drain electrode thereof is connected to the data line 14. The reset line 12, the scan line 13, the data line 14, and the merge line 15 are respectively a part of the controller 7, and actually, control the operation of these circuit elements by supplying a predetermined voltage to the thin film transistor 11 and the like, under the control of a driving circuit (not shown). On the cathode side of the organic LED 1, a power line 16 is arranged, so as to supply electric current at the time of performing the voltage writing phase and the light emitting phase.

The operation of the image display apparatus in Example 1 will be briefly explained with reference to FIGS. 6A and 6B. At first, the reset phase is performed, at which the voltage written in the capacitor 3 in the previous frame is reset. Specifically, while the thin film transistor 11 as the switching element 4 is set to the ON state, by making the potential of the reset line 12 high, the thin film transistor 10 as the switching element 5 and the thin film transistor 9 as the current determining unit 6 maintain the OFF state by making the merge line 15 and the scan line 13 low. As a result, the gate electrode and the drain electrode of the thin film transistor 2 become conductive to each other, and the electric charge accumulated in the capacitor 3 is discharged until the gate to source voltage of the thin film transistor 2 becomes equal to the threshold voltage.

The voltage writing phase is then performed. At the time of performing the voltage writing phase, as shown in FIG. 6B, the potential of the scan line 13 becomes high, the thin film transistor 9 becomes the ON state, the merge line 15 maintains low potential, and the thin film transistor 10 constituting the switching element 5 maintains the OFF state. The thin film transistor 11 constituting the switching element 4 continues to maintain the ON state from the previous step. Further, at the voltage writing phase, the potential of the data line 14 changes to a value corresponding to the value of the voltage to be written.

At the voltage writing phase, the value of the current flowing in the thin film transistor 9 is determined based on the voltage provided by the scan line 13 and the voltage provided by the data line 14. The determined current flows in the organic LED 1, the thin film transistor 2, and the thin film transistor 9. In the thin film transistor 2, a gate to source voltage corresponding to the flowing current is generated, and a voltage equal to the gate to source voltage is written in the capacitor 3.

The voltage writing phase finishes when the potential of the scan line 13 changes to low potential and the thin film transistor 9 becomes the OFF state. However, it is preferable to turn off the thin film transistor 11 constituting the switching element 4, before the thin film transistor 9 becomes the OFF state. If the thin film transistor 11 maintains the ON state until after the thin film transistor 9 becomes the OFF state, the electric charge accumulated in the capacitor 3 may be discharged via between the source and the drain of the thin film transistor 11 and the thin film transistor 2. Therefore, as shown in FIG. 6B, in Example 1, the potential of the reset line 12 changes to low potential at a timing earlier than the potential of the scan lien 13.

Lastly, the light emitting phase is performed. As shown in FIG. 6B, at the light emitting phase, the reset line 12 and the scan line 13 are maintained in the low potential state, and the thin film transistors 11 and 9 are both in the OFF state. On the other hand, the potential of the merge line 15 becomes high, and the switching element 5 becomes the ON state. Therefore, at the light emitting phase, a gate to source voltage having the equal value to that of the voltage written in the capacitor 3 is applied to the thin film transistor 2, and the current corresponding to such a voltage passes through the organic LED 1, the thin film transistor 2, and the switching element 5, so that the organic LED 1 emits light.

In Example 1, the switching elements 4 and 5 are formed of the thin film transistors 11 and 10, and serve as the switching element by supplying a voltage to the gate electrodes of the thin film transistors 11 and 10 via the reset line 12 and the merge line 15. Since the thin film transistors 10 and 11 can have the same configuration as that of the thin film transistors 2 and 9, if those thin film transistors are produced by the same production process, the switching elements 4 and 5 can be formed without increasing the load on the production.

EXAMPLE 2

Example 2 will be explained next. The image display apparatus according to Example 2 has a basic configuration including an equivalent circuit similar to that of Example 1, but is different in a portion corresponding to the switching element 5. That is, in Example 1, the thin film transistor 10 is arranged corresponding to the switching element 5, but in Example 2, the organic LED 1 functions as the switching element 5.

Figure 7A:
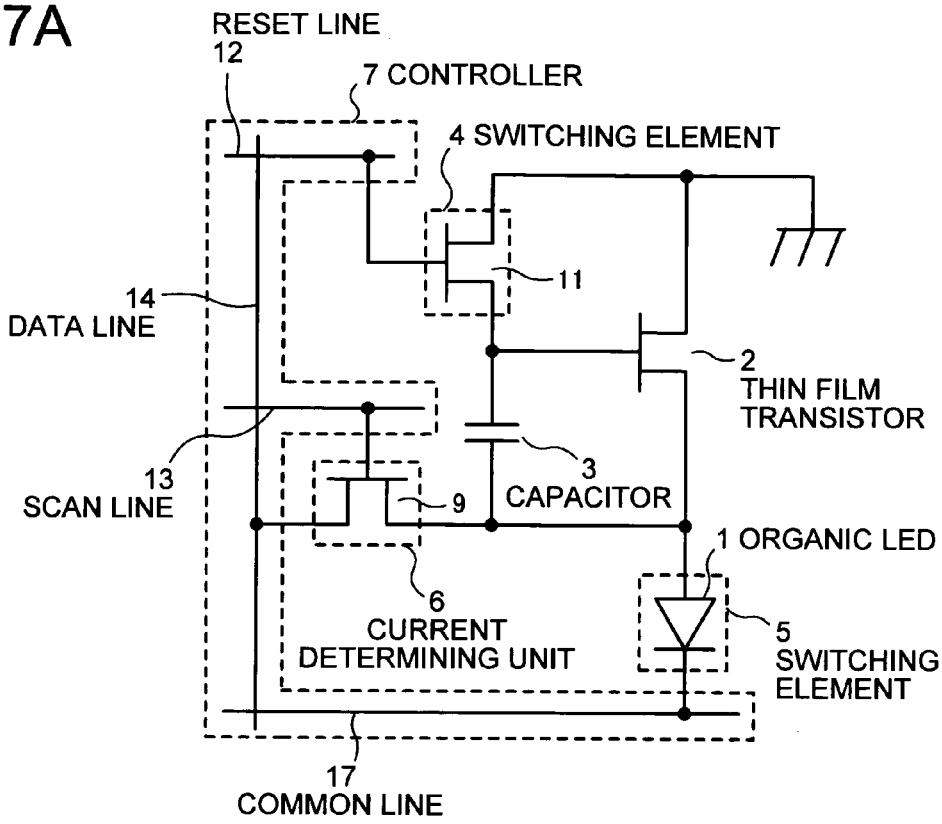
FIG. 7A depicts a circuit configuration in Example 2.
Figure 7B:
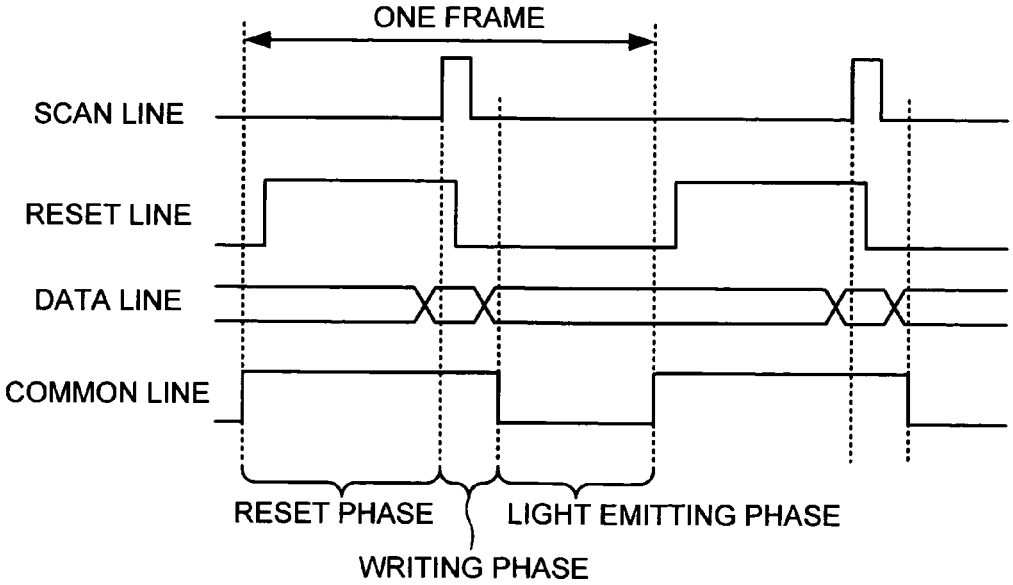
FIG. 7B is a timing chart of the image display apparatus according to Example 2.

The organic LED 1 can be understood as equivalent to a light emitting diode, when considered as a circuit element. When voltage is applied in the forward direction, electric current flows to emit light, and when voltage is applied in the opposite direction, since it serves as a capacitor, the current does not flow. As shown in FIG. 7B, therefore, in the image display apparatus according to Example 2, the potential of a common line 17 is made positive in order to make the switching element 5 OFF, at the reset phase and the voltage writing phase. By setting the common line 17 to the positive potential, a reverse voltage is applied to the organic LED 1 constituting the switching element 5, and the conduction between the thin film transistor 2 and the common line 17 is cut off.

Since the switching element 5 is formed of the organic LED 1, in the image display apparatus according to Example 2, the number of the thin film transistors can be reduced as compared with Example 1, thereby improving the production yield. At the time of performing the light emitting phase, since a plurality of thin film transistors are not serially connected to the organic LED 1, it can be avoided that the current value supplied to the organic LED 1 is restricted by the mobility of the thin film transistor connected thereto in series.

Figure 8:
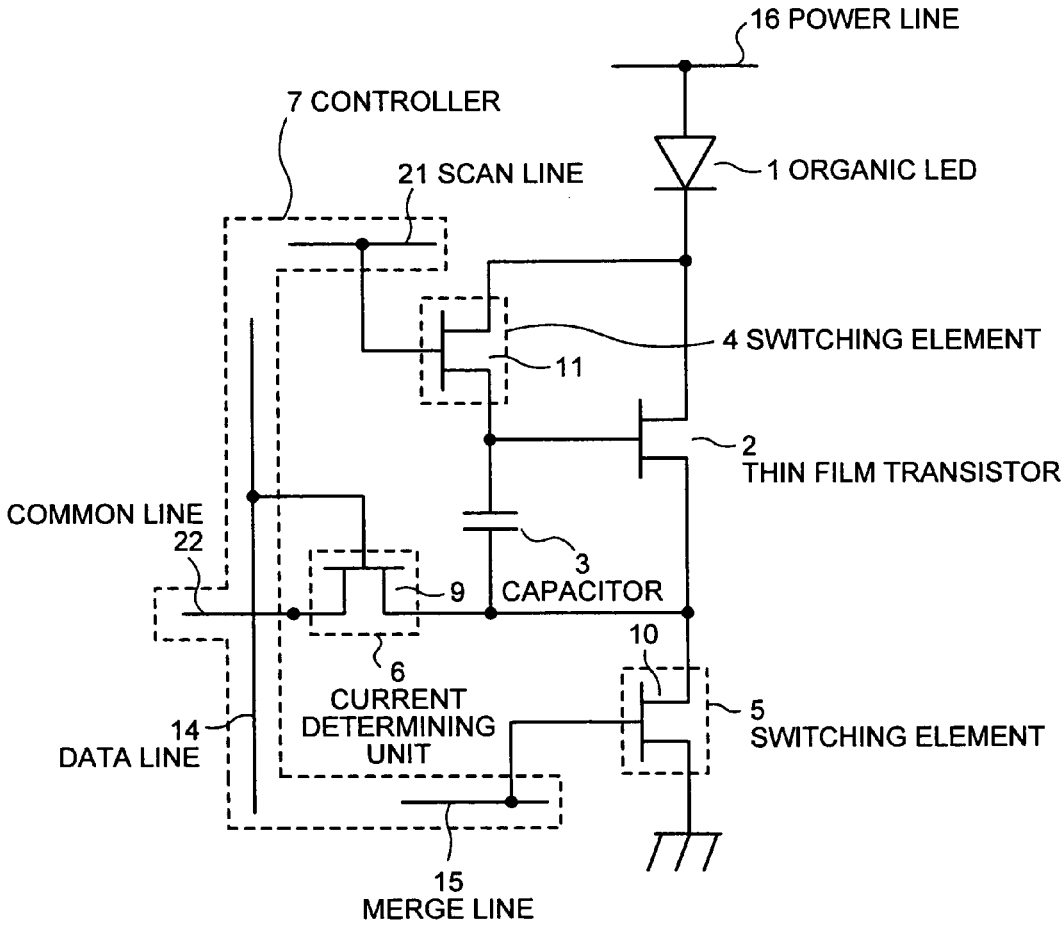
FIG. 8 is a circuit diagram of another example of the circuit configuration for realizing the image display apparatus according to the 15 embodiment.

As a specific example of the image display apparatus according to the embodiment, Examples 1 and 2 have been explained, but the specific examples of the embodiment are not limited to these configurations. For example, as shown in FIG. 8, the configuration may be such that with respect to the thin film transistor 9 constituting the current determining unit 6, the data line 14 connects to the gate electrode, and the common line 22 connects to the drain electrode, and the scan line 21 connects to the gate electrode of the thin film transistor 11 constituting the switching element 4.

Figure 9:
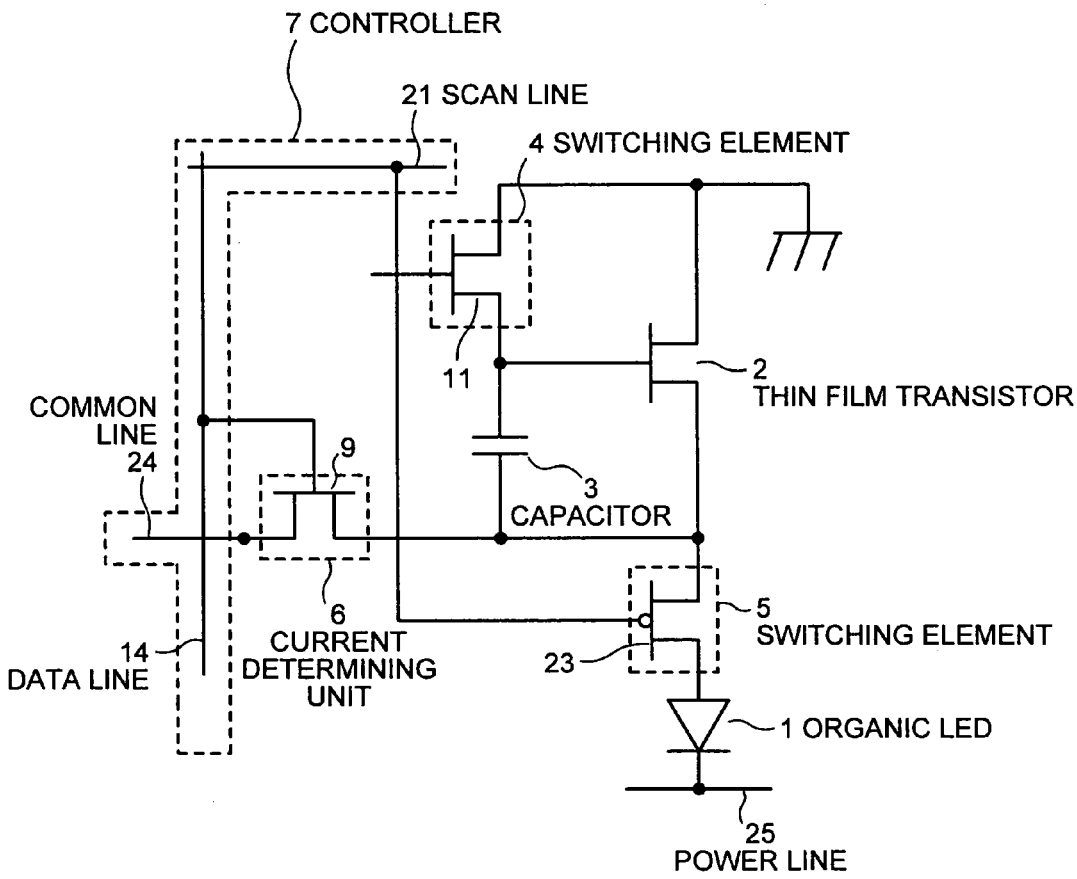
FIG. 9 is a circuit diagram of another example of the circuit configuration for realizing the image display apparatus according to the embodiment.
Figure 10:
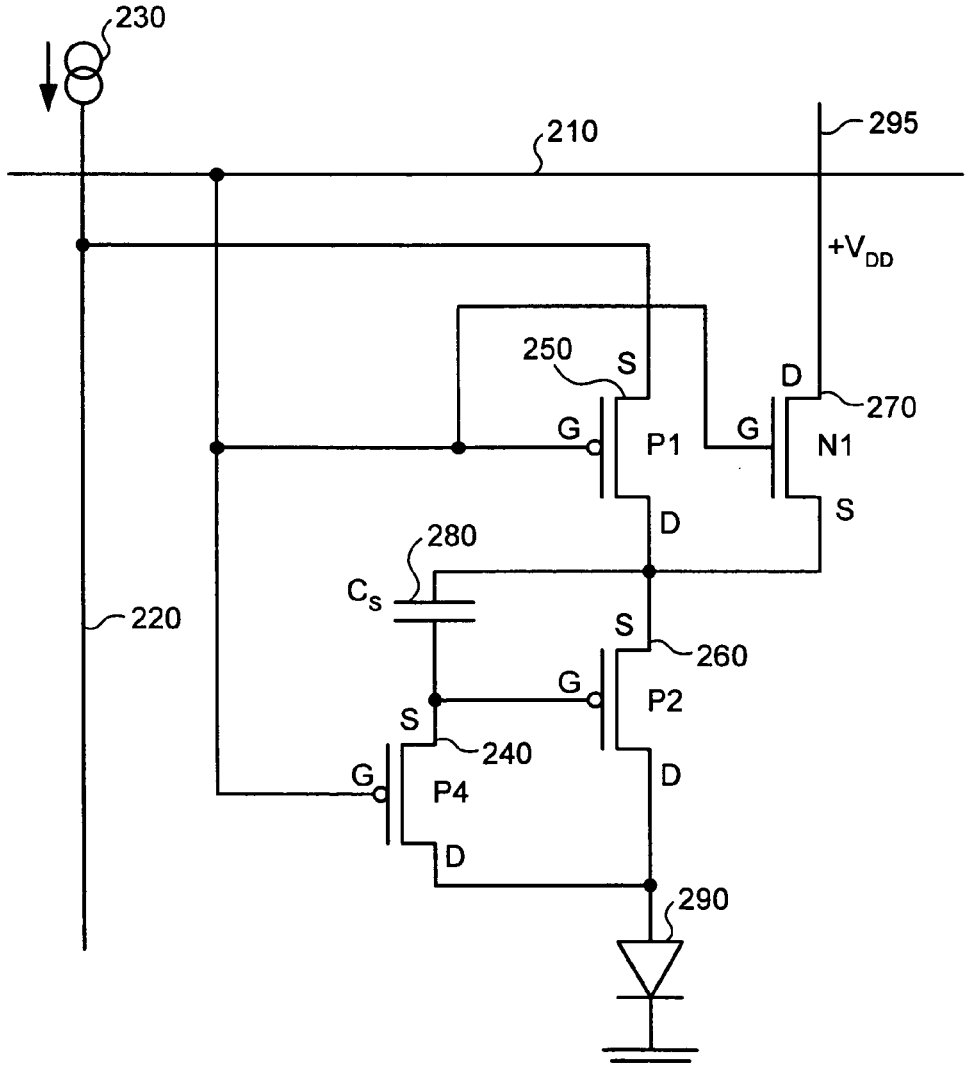
FIG. 10 is an example of a circuit configuration of the conventional art.

As shown in FIG. 9, the number of wiring constituting the controller 7 can be reduced by using a different conductivity type thin film transistor. Specifically, in the example shown in FIG. 9, a p-type thin film transistor 23 is used as a constituent forming the switching element 5.

Further, the number of wiring constituting the controller 7 is reduced by a configuration such that the gate electrode of a thin film transistor 23 and the gate electrode of the thin film transistor 11 constituting the switching element 4 are connected to a common scan line 21. The switching element 4 can function in the OFF state at least at the light emitting phase, while the switching element 5 needs to be in the ON state only at the light emitting phase. Therefore, the driven state can be controlled by supplying the same potential to the respective gate electrodes, by making the conductivity type of the thin film transistors 11 and 23 different.

In the embodiment and Examples, the organic LED is used as the current-controlled light emitting diode, but an inorganic LED or the like may be used. Further, the operation and the like have been explained, assuming that the thin film transistors 2, 9, 10, and 11 are the n-channel type, but these may be the p-channel type, or the configuration may be such that both an n-channel thin film transistor and a p-channel thin film transistor are used.

As the configuration of the current determining unit 6, not only the thin film transistor 9 is simply arranged, but also a compensation circuit for compensating the threshold fluctuation of the thin film transistor 9 may be provided. That is, when the image display apparatus according to the present invention is used over a long period of time, the threshold voltage of the thin film transistor 9 slightly fluctuates as described above. Therefore, it is preferable to exclude the influence of the threshold fluctuation so as to determine the current stably, by providing the circuit for compensating fluctuations in the threshold voltage of the thin film transistor 9. As a specific configuration of the compensation circuit, it is preferable to use a compensation circuit provided for the driver element, for example, in specifications disclosed in Japanese Patent Application Nos. 2003-046541 and 2003-041824, which are incorporated herein by reference.

The current determining unit 6 may be arranged at the position of the switching element 5. Even when the current determining unit 6 is arranged at such a position, since the current value flowing to the organic LED 1 and the thin film transistor 2 can be determined, voltage write can be performed with respect to the organic LED 1 and the thin film transistor 2, while compensating the IV characteristics of the current determining unit 6. Particularly, when the compensation circuit is assembled in the current determining unit 6, fluctuations in the threshold voltage can be compensated, and by arranging the current determining unit 6 at the position of the switching element 5, the current can be determined accurately.

According to the present invention, since the image display apparatus includes the current determining unit that enables voltage write adding the threshold voltage fluctuation of the driver element, and the current determining unit is operated based on a voltage applied from outside, the time required for realizing the current value flowing to the driver element at the time of voltage write can be reduced.

According to the present invention, since the image display apparatus includes the first switching element that discharges the voltage written in the capacitance at the time of displaying the previous frame, the gate to source voltage of the driver element can be reduced to about the threshold voltage, thereby further reducing the time required for voltage write.

According to the present invention, since the thin film transistor serving as the current determining unit operates in the saturation region, the threshold voltage fluctuation of the thin film transistor can be suppressed, thereby realizing the current determining unit having stable IV characteristics.

According to the present invention, since the image display apparatus includes the reverse voltage applying unit that applies reverse voltage to the gate electrode of the thin film transistor serving as the current determining unit, when the threshold voltage of the thin film transistor fluctuates, the fluctuation margin of the threshold voltage can be reduced by applying the reverse voltage.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image display apparatus comprising:

a current-controlled light emitting diode;

a transistor including a gate, a source, and a drain, and controlling a first current flowing through the current-controlled light emitting diode, based on a first voltage applied between the gate and the source at a light emitting phase;

a capacitor arranged between the gate and the source, a second voltage being written in the capacitor at a writing phase; and a current determining unit controlling a second current flowing between the source and the drain, based on a third voltage applied thereto at the writing phase, the second voltage depending on the second current.

2. The image display apparatus according to claim 1, further comprising a first switching element controlling electric conduction between the gate and the drain, and discharging the second voltage written in the capacitance upon displaying a previous frame.

3. The image display apparatus according to claim 1, further comprising:

a wiring configured to connect the transistor and the current determining unit; and a second switching element connected to the transistor, turned off at the writing phase, and turned on to allow the first current to flow through the current-controlled light emitting at the light emitting phase.

4. The image display apparatus according to claim 1, wherein the current determining unit includes a thin film transistor, and determines the second current flowing between the source and the drain, based on the second voltage.

5. The image display apparatus according to claim 4, wherein the thin film transistor operates in a saturation region at the writing phase.

6. The image display apparatus according to claim 4, further comprising a reverse voltage applying unit applying a fourth voltage to a gate of the thin film transistor, the fourth voltage having a polarity opposite to a voltage for turning on the thin film transistor.

7. The image display apparatus according to claim 5, further comprising a reverse voltage applying unit applying a fourth voltage to a gate of the thin film transistor, the fourth voltage having a polarity opposite to a voltage for turning on the thin film transistor.

8. The image display apparatus according to claim 1, wherein the current-controlled light emitting diode includes an organic light emitting diode.

9. The image display apparatus according to claim 1, further comprising a wiring configured to connect the transistor and the current determining unit; wherein the current-controlled light emitting diode serves as a switching element which is turned off at the writing phase, and is turned on to allow the first current to flow through the current-controlled light emitting at the light emitting phase.

* * * * *